US010241474B2

(12) United States Patent
Iijima et al.

(10) Patent No.: US 10,241,474 B2
(45) **Date of Patent: *Mar. 26, 2019**

(54) ELECTRONIC WATCH

(71) Applicant: Seiko Epson Corporation, Tokyo (JP)

(72) Inventors: Yoshitaka Iijima, Omachi (JP); Yasuhiro Momose, Matsumoto (JP); Takaya Masaki, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/399,021

(22) Filed: Jan. 5, 2017

(65) Prior Publication Data

US 2017/0212476 A1 Jul. 27, 2017

(30) Foreign Application Priority Data

Jan. 26, 2016 (JP) ..... 2016-012484

(51) Int. Cl.
*G04B 19/04* (2006.01)
*G04B 19/08* (2006.01)
*G04B 47/06* (2006.01)

(52) U.S. Cl.
CPC ..... *G04B 47/066* (2013.01); *G04B 19/048* (2013.01); *G04B 19/08* (2013.01);
(Continued)

(58) Field of Classification Search
CPC .... G04B 19/048; G04B 19/08; G04B 19/087; G04B 47/06; G04B 47/063; G04B 47/065; G04B 47/066; G04B 47/068; G04R 20/00
See application file for complete search history.

(56) References Cited

U.S. PATENT DOCUMENTS 5,724,317 A * 3/1998 Kubota ..... G01D 13/24 368/10
5,802,016 A * 9/1998 Kubota ..... G04C 3/008 368/11

(Continued)

FOREIGN PATENT DOCUMENTS

JP 2013-092535 A 5/2013

OTHER PUBLICATIONS

Seiko Watch Corporation, Astron GPS Solar Watch Complete User Guide, published in 2014, full document.*

*Primary Examiner* — Daniel P Wicklund
(74) *Attorney, Agent, or Firm* — Harness, Dickey & Pierce, P.L.C.

(57) ABSTRACT

An electronic watch having an altitude display mode of displaying an altitude, a compass display mode of displaying a direction, a barometric pressure display mode of displaying barometric pressure as display modes includes a dial face having an "ALT" area, a "COM" area, and a "BAR" area and a first pointer displaying the altitude display mode by pointing the "ALT" area, displaying the compass display mode by pointing the "COM" area, and displaying the barometric pressure display mode by pointing the "BAR" area. In the dial face, the "ALT" area, "COM" area, and "BAR" area are arranged in an order of the "ALT" area, "COM" area, and "BAR" area. In a turning direction of the first pointer, a distance between the "ALT" area and "COM" area and a distance between the "COM" area and "BAR" area are shorter than a distance between the "ALT" area and "BAR" area.

6 Claims, 7 Drawing Sheets

(52) U.S. Cl.
CPC ..... *G04B 19/087* (2013.01); *G04B 47/06* (2013.01); *G04B 47/063* (2013.01); *G04B 47/065* (2013.01); *G04B 47/068* (2013.01)

(56) References Cited

U.S. PATENT DOCUMENTS

| | | | | |
|---|---|---|---|---|
| 5,889,736 | A | 3/1999 | Fujita et al. | |
| 6,072,752 | A | 6/2000 | Igarashi et al. | |
| 6,349,075 | B1 | 2/2002 | Miyauchi et al. | |
| 6,483,781 | B2 | 11/2002 | Igarashi et al. | |
| 6,490,230 | B1 * | 12/2002 | Sakuyama | G04C 3/14 368/11 |
| 6,751,164 | B1 * | 6/2004 | Sekiguchi | G04C 3/146 368/21 |
| 8,693,290 | B2 | 4/2014 | Sato | |
| 8,717,855 | B2 | 5/2014 | Sato et al. | |
| 8,730,769 | B2 | 5/2014 | Sato | |
| 8,848,491 | B2 | 9/2014 | Miyake | |
| 9,760,063 | B2 * | 9/2017 | Hasegawa | G04G 9/00 |
| 2002/0006080 | A1 * | 1/2002 | Shimizu | G04C 3/146 368/73 |
| 2004/0016058 | A1 * | 1/2004 | Gardiner | B25F 1/04 7/119 |
| 2007/0014193 | A1 * | 1/2007 | Plancon | G04B 19/082 368/80 |
| 2007/0097795 | A1 * | 5/2007 | Hosobuchi | G04B 19/247 368/37 |
| 2007/0183264 | A1 | 8/2007 | Raeber et al. | |
| 2013/0033970 | A1 * | 2/2013 | Miyake | G04C 3/146 368/80 |
| 2013/0064045 | A1 * | 3/2013 | Essery | H04W 88/02 368/47 |
| 2014/0286138 | A1 * | 9/2014 | Hasegawa | G04C 3/14 368/80 |
| 2015/0146503 | A1 * | 5/2015 | Nakanishi | G04R 20/02 368/21 |
| 2015/0253739 | A1 * | 9/2015 | Iida | G04G 9/00 368/80 |
| 2015/0277387 | A1 * | 10/2015 | Hasegawa | G04G 9/00 368/239 |
| 2016/0209813 | A1 * | 7/2016 | Hasegawa | G04R 20/02 |
| 2016/0327915 | A1 * | 11/2016 | Katzer | G04B 19/04 |
| 2016/0341568 | A1 * | 11/2016 | Roush | G01C 22/006 |
| 2017/0277129 | A1 * | 9/2017 | Iijima | G04B 47/066 |

* cited by examiner

ELECTRONIC WATCH

BACKGROUND

1. Technical Field

The present invention relates to an electronic watch.

2. Related Art

Electronic watches that switch and display reception inhibit modes and amounts of battery charge by switching pointed positions of pointers are known (see Patent Document 1 (JP-A-2013-92535)).

Now, an electronic watch that switches and displays an altitude display mode of displaying an altitude, a compass display mode of displaying a direction, a barometric pressure display mode of displaying barometric pressure by switching a pointed position of a pointer considered.

In this case, a user switches among the altitude display mode, the compass display mode, and the barometric pressure display mode displayed by the pointer according to a usage scene. For example, in the usage scene of an outdoor sport such as mountain climbing, there is a high possibility of using the altitude display mode for checking the altitude and using the compass display mode for checking the direction of movement. Or, in the usage scene of a water sport such as navigation of a sailing boat, there is a high possibility of using the barometric pressure display mode for checking the change in the weather according to the change in the barometric pressure and using the compass display mode for checking the direction of movement.

Therefore, in the electronic watch having the plurality of display modes, when the user changes the display mode according to the usage scene, if the switching of the pointed position of the pointer with the change of the display mode takes too much time, the convenience for the user becomes lower.

SUMMARY

An advantage of some aspects of the invention is to suppress reduction of user's convenience by suppressing the excessive time taken to switch the pointed position of the pointer with the change of the display mode.

An electronic watch according to an aspect of the invention has an altitude display mode of displaying an altitude, a compass display mode of displaying a direction, a barometric pressure display mode of displaying barometric pressure as display modes, and includes a member having a first area, a second area, and a third area, and a first pointer that displays the altitude display mode by pointing the first area, displays the compass display mode by pointing the second area, and displays the barometric pressure display mode by pointing the third area. In the member, the first area, the second area, and the third area are arranged in an order of the first area, the second area, and the third area, and, in a turning direction of the first pointer, a distance between the first area and the second area and a distance between the second area and the third area are shorter than a distance between the first area and the third area.

According to the configuration, of the areas pointed by the first pointer, the distance between the areas having higher possibilities of being pointed in the same usage scene (e.g. the distance between the first area and the second area having higher possibilities of being pointed in the usage scene of mountain climbing or the distance between the second area and the third area having higher possibilities of being pointed in the usage scene of navigation of a sailing boat) is shorter than the distance between the areas having lower possibilities of being pointed in the same usage scene (the distance between the first area and the third area). Accordingly, the switching time for the pointed position of the first pointer between the areas having higher possibilities of being pointed in the same usage scene may be made shorter than the switching time for the pointed position of the first pointer between the areas having lower possibilities of being pointed in the same usage scene. Therefore, the excessive time taken to switch the pointed position of the first pointer in the same usage scene can be suppressed.

In the electronic watch according to the aspect, it is desirable that a drive unit that turns the first pointer, and a control unit that controls the drive unit so that the first pointer may point the first area when the display mode is the altitude display mode, the first pointer may point the second area when the display mode is the compass display mode, and the first pointer may point the third area when the display mode is the barometric pressure display mode are provided.

According to the configuration, the control unit can control the pointed position of the first pointer via the drive unit.

In the electronic watch according to the aspect, it is desirable that a second pointer that displays an operating status of the electronic watch by pointing a fourth area and displays a remaining amount of a battery as a power source of the electronic watch by pointing a fifth area is further provided, and a predetermined area containing the first area, the second area, and the third area is adjacent to a specific area containing the fourth area and the fifth area.

For grasping the condition of the electronic watch, a user may check the operating status and the remaining battery of the electronic watch by visually recognizing the pointed position of the second pointer and check the current display mode by visually recognizing the pointed position of the first pointer.

According to the configuration, the predetermined area containing the first area, the second area, and the third area pointed by the first pointer is adjacent to the specific area containing the fourth area and the fifth area pointed by the second pointer. Accordingly, for grasping the condition of the electronic watch, the user can visually recognize the current display mode displayed by the first pointer and the operating status and the remaining battery displayed by the second pointer at a time and lessens the need for large movement of the gaze. Therefore, higher visibility can be obtained with respect to the displayed content of the first pointer and displayed content of the second pointer.

In the electronic watch according to the aspect, it is desirable that the first pointer and the second pointer coaxially turn.

According to the configuration, the first pointer and the second pointer coaxially turn, and thereby, compared to the case where the first pointer and the second pointer respectively turn about different shafts, the space can be saved.

In the electronic watch according to the aspect, it is desirable that the operating status displayed by the second pointer includes a measuring status referring to executing a measurement corresponding to the display mode displayed by the first pointer, and a six area corresponding to the measuring status of the fourth area is adjacent to the predetermined area.

According to the configuration, the area corresponding to the measuring status (the sixth area pointed by the second pointer) is adjacent to the predetermined area pointed by the first pointer. Accordingly, the user can visually recognize the display mode within the predetermined area pointed by the first pointer and the display as to whether or not the measurement corresponding to the display mode is being executed (the display by the second pointer) at a time.

In the electronic watch according to the aspect, it is desirable that the second pointer moves by an angle obtained by division of 360° by 4n (n is a natural number less than 15).

In the electronic watch with pointer, generally, a configuration of moving the pointer by an angle obtained by division of 360° by 60 is used. On the other hand, the second pointer is moved by an angle obtained by division of 360° by 4n, and thereby, compared to the case where the second pointer is moved by an angle obtained by division of 360° by 60, the distance at which the second pointer moves by single movement may be made longer. Therefore, the switching time for the pointed position of the second pointer can be shortened.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
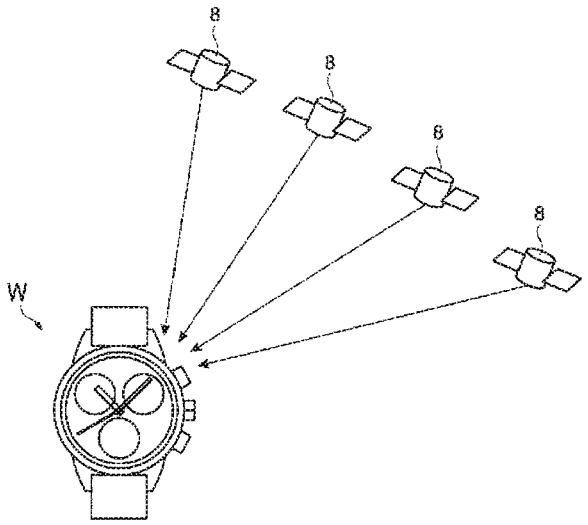
FIG. 1 is an overall view of GPS including an electronic watch according to an embodiment of the invention.

As below, embodiments according to the invention will be explained with reference to the drawings. Note that, in the drawings, dimensions and scales of the respective parts are different from the real ones as appropriate. Further, the embodiments to be described later are preferable specific examples of the invention with technically preferable various limitations, however, the scope of the invention is not limited to these embodiments unless there is description that particularly limits the invention in the following explanation.

FIG. 1 is an overall view of GPS including an electronic watch with sensor (hereinafter, simply referred to as "electronic watch") W according to the embodiment. The electronic watch W obtains location information and time information of the current location using radio waves as an example of an external signal.

The electronic watch W is a wristwatch that receives radio waves (satellite signals) from GPS satellites 8 and corrects the internal time. The electronic watch W displays a time etc. on an opposite face (hereinafter, referred to as "front face") to a face to be in contact with the arm (hereinafter, referred to as "back face"). The GPS satellites 8 are navigation satellites that orbit in predetermined orbits in the airspace above the earth. The GPS satellites 8 transmit radio waves (L1 waves) at 1.57542 GHz with navigation messages superimposed thereon to the ground. In the following explanation, the radio waves at 1.57542 GHz with navigation messages superimposed thereon will be referred to as satellite signals. The satellite signals are right-handed circularly polarized waves.

At present, about 31 GPS satellites 8 (only four are shown in FIG. 1) exist. To identify the GPS satellites 8 transmitting the satellite signals, the respective GPS satellites 8 superimpose 1023-chip (1 ms-cycle) unique patterns called C/A codes (Coarse/Acquisition codes) on the satellite signals. The C/A code has respective chips taking +1 or −1 and appears a random pattern. Therefore, the C/A codes superimposed on the satellite signals may be detected by correlation of the satellite signals with the respective C/A code patterns.

The GPS satellites 8 contain atomic clocks. The satellite signals include extremely accurate GPS time information timed by the atomic clocks. By control segments on the ground, slight time errors of the atomic clocks in the respective GPS satellites 8 are measured. The satellite signals also include time correction parameters for correction of the time errors. The electronic watch W receives the satellite signal (radio wave) transmitted from one GPS satellite 8 and uses an accurate time (time information) obtained using the GPS time information and the time correction parameter contained therein as an internal time.

The satellite signal also includes orbit information indicating the position of the GPS satellite 8 in the orbit. The electronic watch W may perform positioning calculation using the GPS time information and the orbit information. The positioning calculation is performed on the assumption that the internal time of the electronic watch W contains a certain level of error. That is, in addition to x, y, z parameters for specifying the three-dimensional location of the electronic watch W, the time error is unknown. Accordingly, the electronic watch W receives the satellite signals respectively transmitted from the four or more GPS satellites 8, performs positioning calculation using the GPS time information and the orbit information therein, and obtains location information of the current location.

Explanation of Overall Configuration of Electronic Watch W

Figure 2:
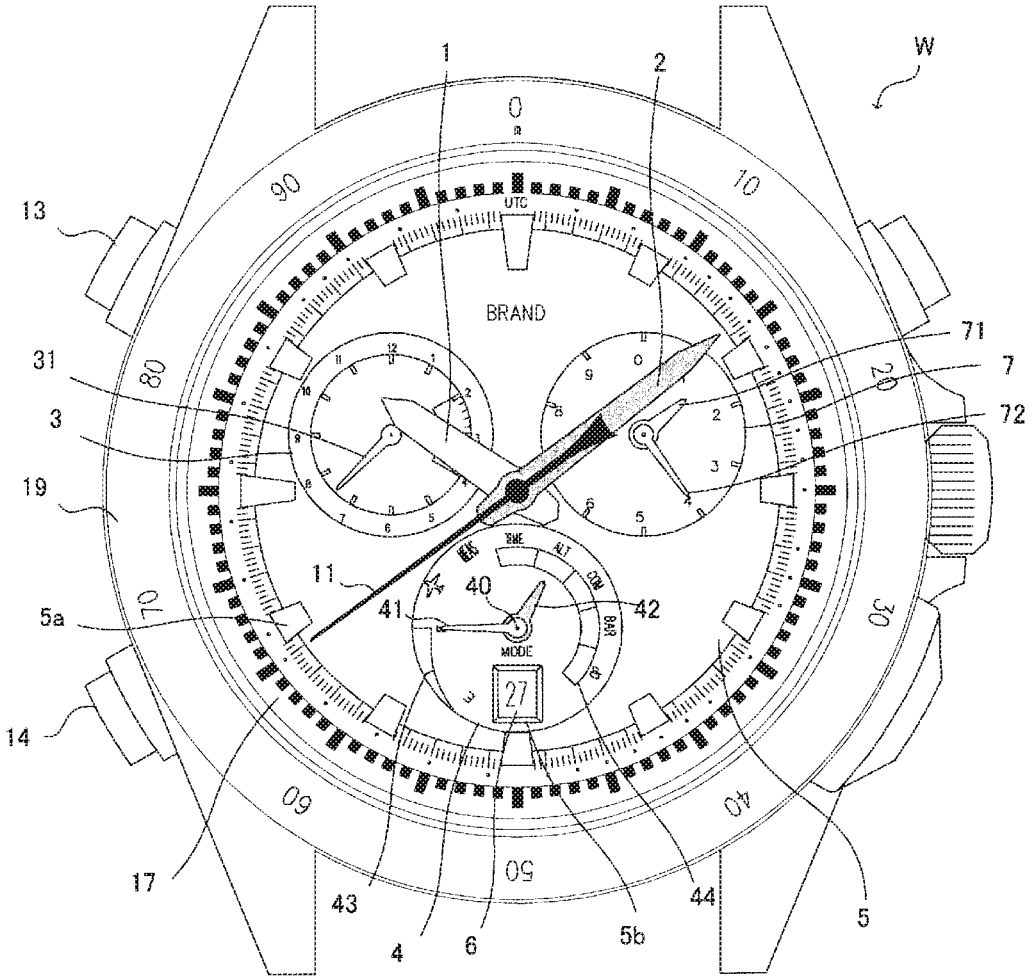
FIG. 2 is a plan view showing an example of the electronic watch according to the embodiment.
Figure 3:
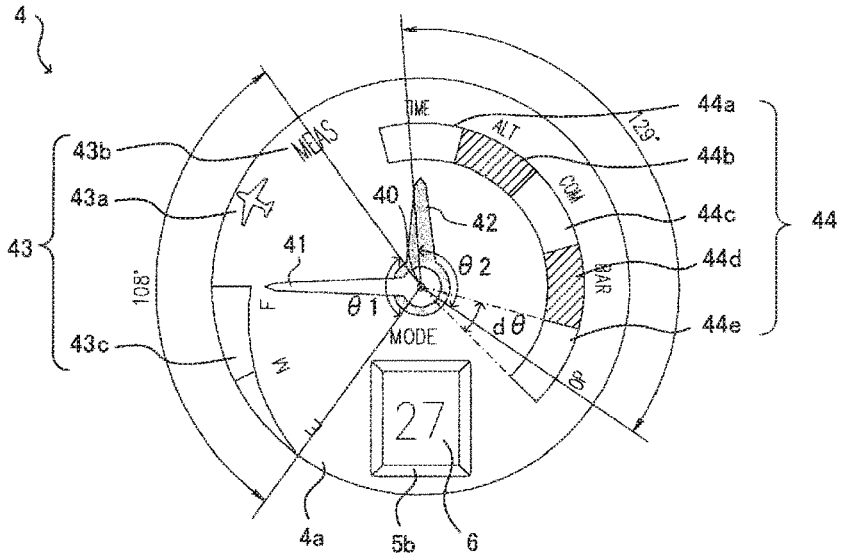
FIG. 3 is an enlarged plan view showing an information display part on a six o'clock side shown in FIG. 2.

FIG. 2 is a plan view showing the electronic watch W. FIG. 3 is an enlarged plan view of a circular information display part on the six o'clock side (hereinafter, referred to as "six o'clock information display part") 4 of the electronic watch W shown in FIG. 2.

Next, the schematic configuration of the electronic watch W will be explained with reference to FIGS. 2 and 3.

The electronic watch W includes an altitude sensor, a direction sensor, and a barometric pressure sensor as will be described later.

The electronic watch W includes a time display mode of displaying the time, an altitude display mode of displaying the altitude, a compass display mode of displaying the direction, a barometric pressure mode of displaying the barometric pressure, and an optional display mode as display modes as display modes.

The optional display mode is a mode of displaying biological information measured by an apparatus that measures biological information such as a pulse rate sensor, for example, in wireless or wired connection to the electronic watch W. Note that the optional display mode can be changed as appropriate, not limited to the mode of displaying biological information.

As shown in in FIG. 2, the display modes are switched according to switching among areas pointed by the first pointer 42 within the six o'clock information display part 4.

As shown in FIG. 3, in the six o'clock information display part 4, an "ALT" area 44*b* corresponding to the altitude display mode, a "COM" area 44*c* corresponding to the compass display mode, a "BAR" area 44*d* corresponding to the barometric pressure display mode are arranged in the order of the "ALT" area 44*b*, "COM" area 44*c*, and "BAR" area 44*d*. The "ALT" area 44*b*, "COM" area 44*c*, and "BAR" area 44*d* are examples of a first area, a second area, and a third area, respectively.

Further, an area corresponding to the time display mode ("TIME" area) 44*a* is provided on the opposite side of the "ALT" area 44*b* to the "COM" area 44*c*. An area corresponding to the optional display mode ("OP" area) 44*e* is provided on the opposite side of the "BAR" area 44*d* to the "COM" area 44*c*.

The first pointer 42 points the "TIME" area 44*a* to display that the display mode is the time display mode. The first pointer 42 points the "ALT" area 44*b* to display that the display mode is the altitude display mode. The first pointer 42 points the "COM" area 44*c* to display that the display mode is the compass display mode. The first pointer 42 points the "BAR" area 44*d* to display that the display mode is the barometric pressure display mode. The first pointer 42 points the "OP" area 44*e* to display that the display mode is the optional display mode.

In the turning direction (revolving direction) of the first pointer 42, the distance between the "ALT" area 44*b* and the "COM" area 44*c* is shorter than the distance between the "ALT" area 44*b* and the "BAR" area 44*d*, and the distance between the "COM" area 44*c* and the "BAR" area 44*d* is shorter than the distance between the "ALT" area 44*b* and the "BAR" area 44*d*.

The areas corresponding to the respective display modes are placed in consideration of usage scenes.

In everyday life, generally, the use frequency of the time display mode is higher. Accordingly, the "TIME" area 44*a* (corresponding to the time display mode) is placed in the twelve o'clock position that is most visually recognizable.

Or, in the usage scene of an outdoor sport such as mountain climbing, there is a higher possibility of using the altitude display mode and the compass display mode. Accordingly, the "ALT" area 44*b* (corresponding to the altitude display mode) and the "COM" area 44*c* (corresponding to the compass display mode) having higher possibilities of being pointed by the first pointer 42 in the usage scene of an outdoor sport such as mountain climbing are placed subsequently to the "TIME" area 44*a* in this order.

Note that the compass display mode (corresponding to the "COM" area 44*c*) has a higher possibility of being used not only in the usage scene of an outdoor sport such as mountain climbing but also in the usage scene of a water sport such as navigation of a sailing boat.

Further, in the usage scene of a water sport such as navigation of a sailing boat, there is a higher possibility of using the barometric pressure display mode (corresponding to the "BAR" area 44*d*) like the compass display mode (corresponding to the "COM" area 44*c*). Accordingly, the "BAR" area 44*d* (corresponding to the barometric pressure display mode) is placed next to the "COM" area 44*c*.

As described above, the distance between the areas having higher possibilities of being used in the same usage scene (the distance between the "ALT" area 44*b* and the "COM" area 44*c* or the distance between the "COM" area 44*c* and the "BAR" area 44*d*) is shorter than the distance between the areas having lower possibilities of being used in the same usage scene (the distance between the "ALT" area 44*b* and the "BAR" area 44*d*). Accordingly, the switching time for the pointed position of the first pointer 42 between the areas having higher possibilities of being pointed in the same usage scene may be made shorter than the switching time for the pointed position of the first pointer 42 between the areas having lower possibilities of being pointed in the same usage scene. Therefore, the excessive time taken to switch the pointed position of the first pointer 42 in the same usage scene can be suppressed.

The altitude in the altitude display mode, the barometric pressure in the barometric pressure display mode, and the pulse rate in the optional display mode are displayed by a circular information display part on the two o'clock side (hereinafter, referred to as "two o'clock information display part") 7 of the electronic watch W shown in FIG. 2 and scale markings divided in 100 on an annular dial ring 17 and a measurement pointer 11.

Specifically, in the two o'clock information display part 7, a measurement pointer 71 displays the value of thousands place of the measurement value (altitude, barometric pressure, pulse rate) and a measurement pointer 72 displays the value of hundreds place of the measurement value. The measurement pointer 11 displays the value of tens place and the value of ones place of the measurement value using the scale markings (divided in 100) of the dial ring 17.

For example, when the first pointer 42 within the six o'clock information display part 4 points the "ALT" area 44*b*, the altitude measurement value is displayed by the two o'clock information display part 7 and the measurement pointer 11. Further, when the first pointer 42 within the six o'clock information display part 4 points the "BAR" area 44*d*, the barometric pressure measurement value is displayed by the two o'clock information display part 7 and the measurement pointer 11.

The direction in the compass display mode is displayed by the measurement pointer 11 pointing the northward direction. That is, when the first pointer 42 within the six o'clock information display part 4 points the "COM" area 44*c*, the northward direction is displayed by the measurement pointer 11.

The time in the time display mode is displayed by an hour hand 1 showing the hour, a minute hand 2 showing the minute, a circular information display part on the ten o'clock side (hereinafter, referred to as "ten o'clock information display part") 3 of the electronic watch W showing the second. That is, when the first pointer 42 within the six o'clock information display part 4 points the "TIME" area 44*a*, the time is displayed by the hour hand 1, the minute hand 2, and the information display part 3. Note that the hour hand 1 and the minute hand 2 show the time (hour and minute) in any other display mode.

Here, as additional description of FIGS. 1 and 2, FIG. 1 shows the electronic watch W when the display mode is the attitude display mode ("ALT") and FIG. 2 shows the six o'clock information display part 4 when the display mode is the time display mode ("TIME").

Next, the details of the electronic watch W will be explained.

In FIG. 2, the electronic watch W receives radio waves containing time information and corrects the displayed time based on the time information. In the electronic watch W, a dial face 5 is provided on the inner circumference side of the dial ring 17 and a bezel 19 is provided coaxially with the dial ring 17 on the outer circumference side of the dial ring 17. The hour hand 1 and the minute hand 2 are attached to the dial face 5. A scale 5*a* for 12-hour notation is annularly formed in a position corresponding to the hour hand 1 of the dial face 5. The ten o'clock information display part 3 with a second hand 31 attached thereto is formed in the direction showing ten o'clock of the dial face 5.

The measurement pointer 11 is attached to the dial face 5. For example, the measurement pointer 11 displays a corresponding value of 0 to 99 as a measurement result based on the output from the altitude sensor that measures the altitude under the altitude display mode. Specifically, the measurement pointer 11 displays numbers of tens place and ones place in the measurement result of the altitude using the markings divided in 100 on the dial ring 17 in the outer circumference part of the dial face 5. The two o'clock information display part 7 with the measurement pointers 71 and 72 for displaying the hundreds place and the thousands place in the measurement result of the altitude attached thereto is formed in the direction showing two o'clock of the dial face 5. In the illustrated example, the measurement pointers 71 and 72 show the altitude of 1400 m and the measurement pointer 11 shows the altitude of 65 m. Thereby, a user may know that the altitude is 1465 m.

The six o'clock information display part 4 with the first pointer 42 for displaying first information and the second pointer 41 for displaying second information attached thereto is placed in the direction showing six o'clock of the dial face 5. The first information and the second information are other information than the time.

As specifically shown in FIG. 3, a dial face 4*a* of the six o'clock information display part 4 has a first display area 44 and a second display area 43. The first display area 44 and the second display area 43 are placed to be adjacent to each other, not to overlap each other. The dial face 4*a* is an example of a member.

The second display area 43 is a range having a sector shape with a center angle θ1 (108°) about a coaxial shaft 40. The second display area 43 is an example of a specific area or an example of an area that can be pointed by the second pointer 41.

The first display area 44 is a range having a sector shape with a center angle θ2 (129°) about the coaxial shaft 40. The first display area 44 is an example of the specific area or an example of an area that can be pointed by the first pointer 42. The respective display areas 43 and 44 are divided in pluralities of display units by turning angles about the coaxial shaft 40.

In the second display area 43, an area showing the remaining battery (43*c*) and areas showing operating statuses of the electronic watch W (43*a* and 43*b*) are provided. The second pointer 41 displays the remaining battery by pointing the area showing the remaining battery. Further, the second pointer 41 displays the operating status of the electronic watch W by pointing the area showing the operating status of the electronic watch W.

The operating status of the electronic watch W includes "NO WIRELESS CONNECTION" referring to the stop of receiving radio waves including time information and "MEASURING" referring to executing measurement (measurement of time, altitude, direction, barometric pressure) corresponding to the display mode displayed by the first pointer 42.

In the embodiment, in the second display area 43, a remaining battery meter 43*c*, an icon 43*a* showing no wireless connection, and characters 43*b* of "MEAS" showing "measuring" are provided. The area in which the remaining battery meter 43*c* is located is an example of a fifth area. The area in which the icon 43*a* is located and the area in which the characters 43*b* of "MEAS" are located are examples of fourth areas corresponding to the operating status of the electronic watch W. The area in which the characters 43*b* of "MEAS" are located is also an example of a sixth area. The area in which the characters 43*b* of "MEAS" are located is adjacent to the first display area 44.

The second pointer 41 alternatively displays the remaining battery and the operating status of the electronic watch W by the turning about the coaxial shaft 40 in the second display area 43.

On the other hand, the first pointer 42 displays the current display mode (one of the time display mode, the altitude display mode, the compass display mode, the barometric pressure display mode, and the optional display mode) by the turning about the coaxial shaft 40 in the first display area 44.

Note that the respective display modes show kinds of measurement values in the display modes. For example, the time display mode shows the time as the kind of the measurement value, the altitude display mode shows the altitude as the kind of the measurement value, the compass display mode shows the direction as the kind of the measurement value, the barometric pressure display mode shows the barometric pressure as the kind of the measurement value, and the optional display mode shows the biological information as the kind of the measurement value.

The first pointer 42 is driven by a reduction mechanism that decelerates the turning of the second pointer 41 to turn the first pointer 42.

The second pointer 41 displays the second information (remaining battery and the operation status of the electronic watch W) by moving in a range of 108° from the "MEAS" position to the "E" position (empty position) in the range of ±54° with respect to the "F" position (full position).

When the second pointer 41 moves in the range of 108° from the "MEAS" position to the "E" position, the first pointer 42 moves the displayed position in a range of 4.5° by the above described reduction mechanism. Here, the display units ("TIME" area, "ALT" area, "COM" area, "BAR" area, "OP" area) 44*a* to 44*e* of the respective display modes are ranges of 30° (=0±15°). Accordingly, even when the first pointer 42 turns in the range of 4.5° with the turning of the second pointer 41, the area (display unit) pointed by the first pointer 42 is not changed and the possibility of misreading of the display mode pointed by the first pointer 42 by the user may be made lower. The angle 30° (±15°) is an example of an angle dθ.

Note that, if the user operates the button when the wireless function (receiving function of radio waves including time information) is disabled in such a case where the user carrying the electronic watch W is on board an airplane, the second pointer 41 points the icon 43*a* showing no wireless connection.

The first display area 44 includes the "TIME" area 44*a*, the "ALT" area 44*b*, the "COM" area 44*c*, the "BAR" area 44*d*, and the "OP" area 44*e*.

In the first display area 44, the first pointer 42 alternatively points the display units ("TIME" area, "ALT" area, "COM" area, "BAR" area, "OP" area) 44*a* to 44*e* of the respective display modes, and thereby, displays the current display mode.

In the embodiment, the display units 44*a* to 44*e* of the respective display modes are shown by characters written in the area having a belt-like arc shape. Specifically, as the display units 44*a* to 44*e*, "TIME" (time), "ALT" (altitude), "COM" (compass: direction), "BAR" (barometric pressure), "OP" (option) are shown.

The display mode displayed by the pointed position of the first pointer 42, i.e., the display mode displayed in the first display area 44 is switched by a press-down operation of a button 14.

For example, at each time when the button 14 is pressed down, the second pointer 41 turns clockwise by 360° and the first pointer 42 turns clockwise by 30° as the example of the angle dθ. Accordingly, at each time when the button 14 is pressed down, the display mode is sequentially switched from the time display mode ("TIME" mode) to the altitude display mode ("ALT" mode), the compass display mode ("COM" mode), the barometric pressure display mode ("BAR" mode), and the optional display mode ("OP" mode).

Further, when the button 14 is pressed down in the state in which the first pointer 42 points the optional display mode ("OP" mode), the first pointer 42 moves reversely to the "TIME" area 44*a* (time display mode area). Note that, in the example shown in FIG. 3, the second pointer 41 shows the remaining battery "F" (full) and the first pointer 42 shows the time display mode.

An information display part 5*b* for see-through view of a day wheel 6 for displaying the calendar is formed in the direction showing six o'clock on the dial face 4*a* of the six o'clock information display part 4. The information display part 5*b* is an example of a third display area fixedly provided on a line passing through the coaxial shaft 40 and connecting the twelve o'clock side and the six o'clock side in an area not overlapping with the first and second display areas 44, 43. The information display part 5*b* displays the date of the calendar as an example of third information. The information display part 5*b* is fixedly provided on the line passing through the coaxial shaft 40 and connecting the twelve o'clock side and the six o'clock side, and thereby, the symmetrical design of the whole electronic watch W is realized.

Figure 4:
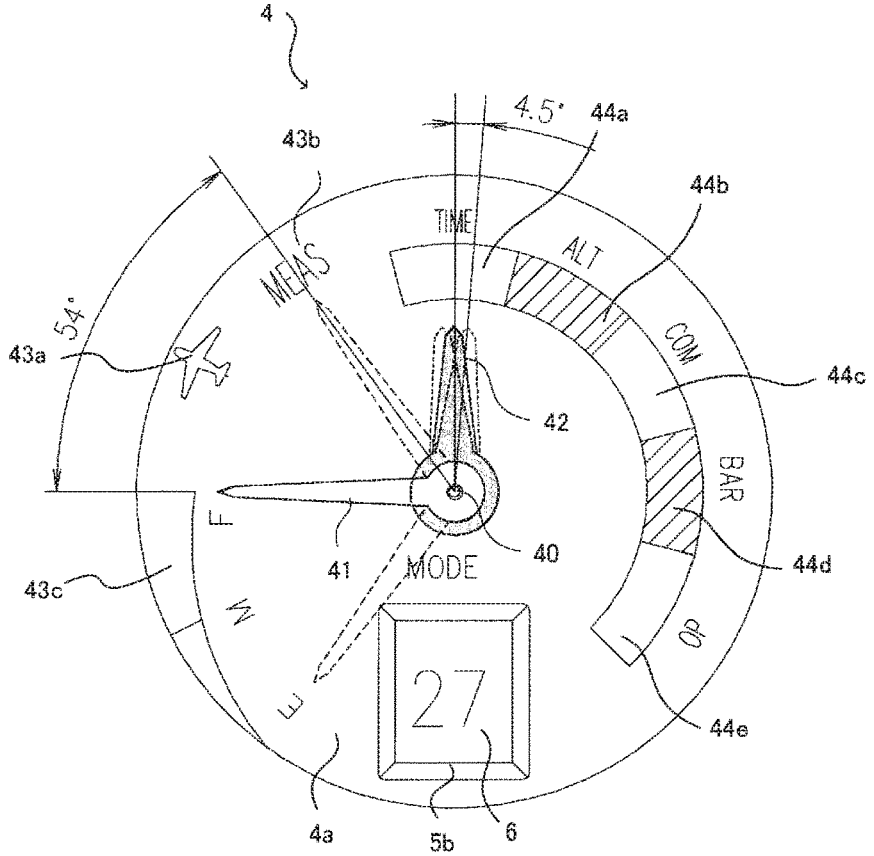
FIG. 4 is a plan view showing a turning range of a first pointer 42 in conjunction with a turning range of a second pointer 41.

FIG. 4 is shows the turning range of the first pointer 42 in conjunction with the turning range of the second pointer 41. In the example shown in FIG. 4, the first pointer 42 points the display unit 44*a* ("TIME" area). When the first pointer 42 points the display unit 44*a*, the display mode is the time display mode. In the time display mode, a chronograph function (stopwatch) is enabled in addition to the time display.

When a button 13 is pressed down in the state shown in FIG. 3, the measurement pointer 11 shown in FIG. 2 starts to move by ⅕ seconds and, simultaneously, as shown in FIG. 4, the second pointer 41 of the six o'clock information display part 4 turns clockwise from the position showing the remaining battery "F" by 54° and moves to the position showing the characters 43*b* of "MEAS" referring to measuring. Concurrently, the first pointer 42 turns clockwise by 4.5° in conjunction with the turning of the second pointer 41. Here, the display unit 44*a* of the "TIME" area has a width of 30°. Therefore, the first pointer 42 still points the display unit 44*a* of the "TIME" area. Similarly, when the second pointer 41 turns counter-clockwise from the position showing the remaining battery "F" by 54° and shows the remaining battery "E", the first pointer 42 turns counter-clockwise by 4.5°, but still points the display unit 44*a* of the "TIME" area.

Configuration of Drive System

Figure 5:
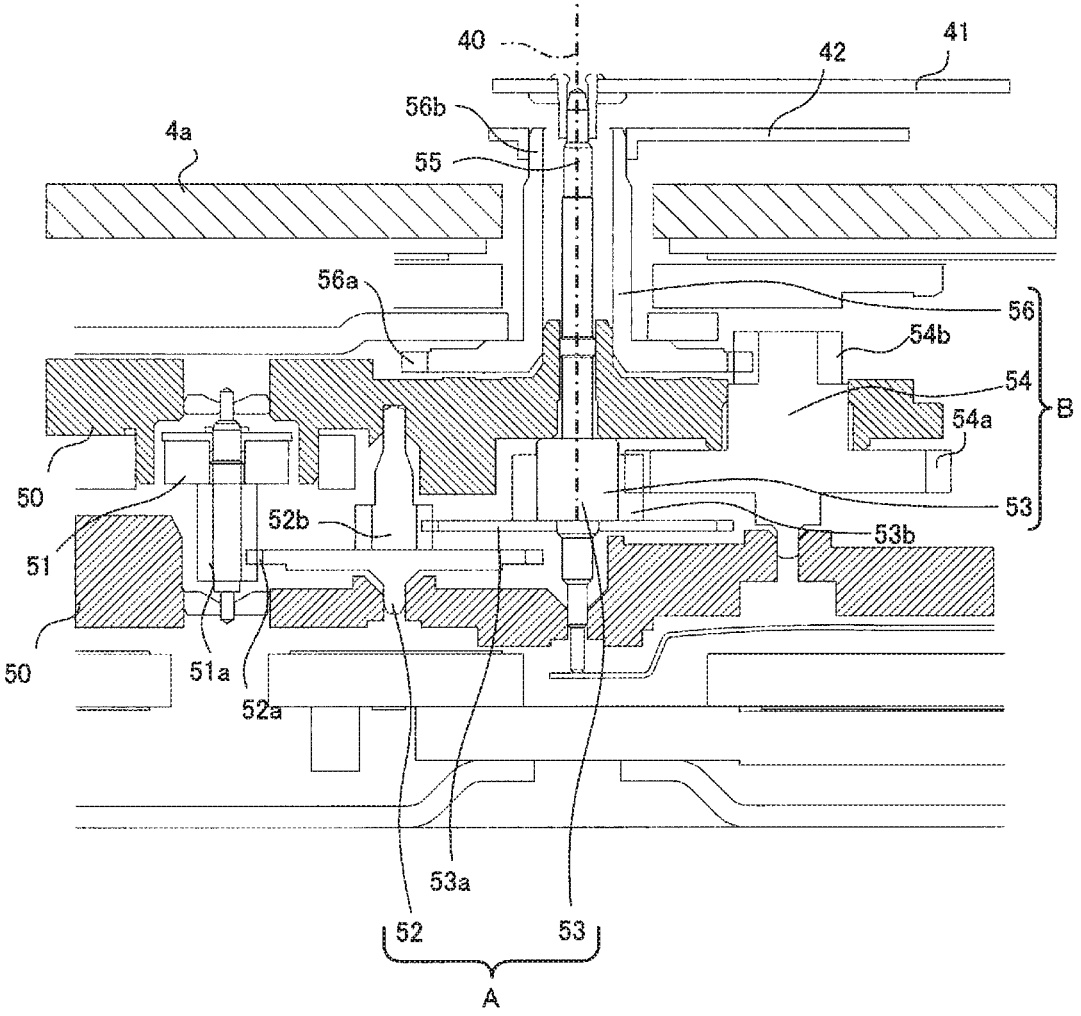
FIG. 5 is a sectional view showing a drive system of the information display part on the six o'clock side according to the embodiment.

The drive system of the pointers will be explained. FIG. 5 is a sectional view showing a configuration of the six o'clock information display part 4 according to the embodiment, and FIG. 6 is a plan view of the drive system etc.

Figure 6:
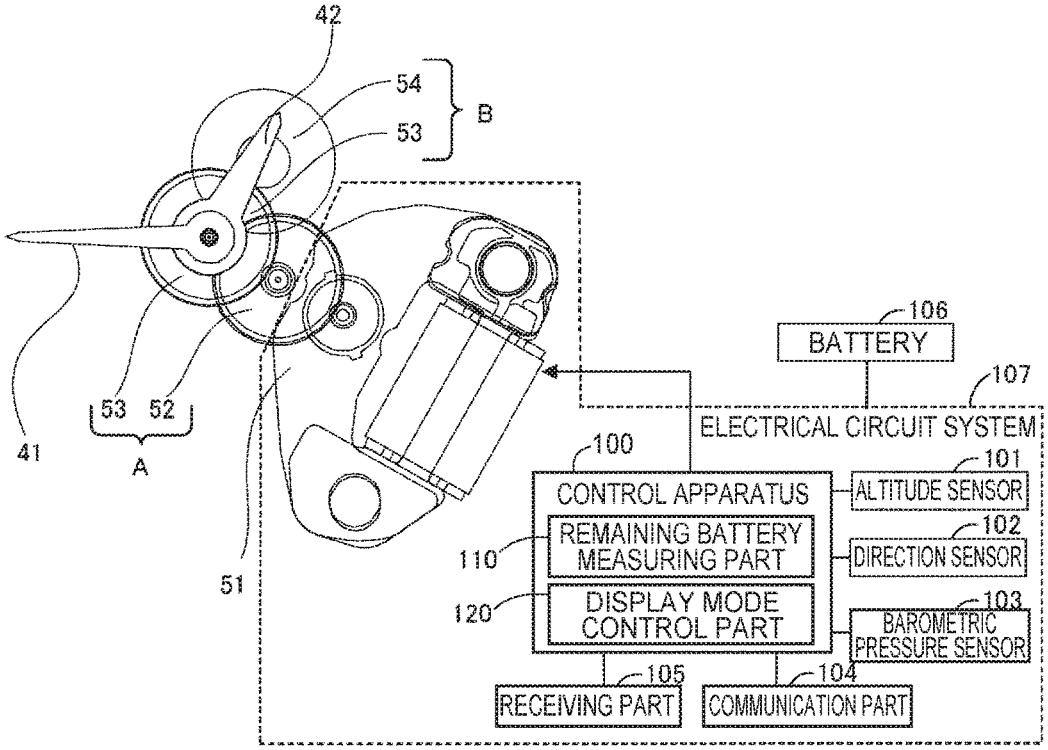
FIG. 6 is a plan view showing a drive system of the information display part on the six o'clock side according to the embodiment.

As shown in FIGS. 5 and 6, the first pointer 42 and the second pointer 41 are driven by a common step motor 51 and coaxially turn via an intermediate wheel 52 or 54. In the electronic watch W, a power transmission mechanism A that turns the second pointer 41 at a first speed and a reduction mechanism B that decelerates the turning of the second pointer 41 and turns the first pointer 42 at a second speed using the drive power from the step motor 51 as a drive source are provided. The step motor 51, the power transmission mechanism A, and the reduction mechanism B form a drive unit. The power transmission mechanism A and the reduction mechanism B use the step motor 51 as a common drive source. In the power transmission mechanism A and the reduction mechanism B, part of gears etc. are used in common. Specifically, the power transmission mechanism A includes the intermediate wheel 52 and a remaining battery display wheel 53, and the reduction mechanism B includes the remaining battery display wheel 53, the intermediate wheel 54, and a mode display wheel 56. The remaining battery display wheel 53 turns so that the second pointer 41 may alternatively points not only the remaining battery meter 43*c* but also the icon 43*a* showing no wireless connection and the characters 43*b* of "MEAS" showing measuring.

Specifically, the step motor 51 is the drive source for driving the first pointer 42 and the second pointer 41. The step motor 51 includes a coil block, a stator, and a rotor 51*a*. The step motor 51 rotates when drive pulse is supplied. The coil block includes a magnetic core of a high magnetic permeability material, a coil wounded around the core, a coil lead substrate with both ends processed to be conductive, and a coil frame. The stator is formed of a high magnetic permeability material like the magnetic core. In the rotor 51*a*, a metal fitting is attached to a rotor magnet. As a power source for the drive source of the step motor 51 etc., e.g. a coin-type lithium battery is used. A direct-current voltage at 3 V is applied to the coil block.

The step motor 51 rotates by the drive pulse output from a control apparatus 100 such as a CPU-IC (see FIG. 6). The control apparatus 100 is an example of a control unit.

The CPU-IC is an arithmetic processing apparatus that controls the operation of the whole electronic watch W. The CPU-IC receives button operation etc. of the user and is connected to an altitude sensor 101, a direction sensor 102, a barometric pressure sensor 103, a communication part 104, and a receiving part 105.

An electrical circuit system 107 including the control apparatus 100, the altitude sensor 101, the direction sensor 102, the barometric pressure sensor 103, the communication part 104, the receiving part 105, and the step motor 51 is driven by a battery 106 as a power source.

The CPU-IC also functions as a remaining battery measuring part 110 that measures the remaining battery and a display mode control part 120 that controls the display mode. Further, the CPU-IC outputs the drive pulse of the step motor 51 according to the operation by the user and executes control of the respective displays in the six o'clock information display part 4.

The altitude sensor 101 measures the altitude. The direction sensor 102 measures the direction. The barometric pressure sensor 103 measures the barometric pressure. The communication part 104 communicates with a device that measures biological information such as a pulsebeat sensor used in the optional display mode in wireless or wired connection. The receiving part 105 includes an antenna and acquires GPS time information and location information by processing satellite signals received via the antenna.

The control apparatus 100 drives the step motor 51 to drive the first pointer 42 and the second pointer 41. Further, the control apparatus 100 respectively drives the hour hand 1, the minute hand 2, the second hand 31, the day wheel 6, the measurement pointers 11, 71, and 72 via drive mechanisms (not shown) for displaying the measurement value of the altitude sensor 101, the measurement value of the direction sensor 102, the measurement value of the barometric pressure sensor 103, the biological information acquired by the communication part 104, and the internal time corrected by the time information acquired using the receiving part 105.

As shown in FIG. 5, the rotor 51*a* of the step motor 51 meshes with a lower gear 52*a* of the intermediate wheel 52 and rotates a lower gear 53*a* of the remaining battery display wheel 53 via an upper gear 52*b* integrally rotating with the lower gear 52*a*. The remaining battery display wheel 53 integrally rotates with a rotation shaft 55. The rotation shaft 55 rotates about the above described coaxial shaft 40. The rotation shaft 55 rotates about the coaxial shaft 40 via the remaining battery display wheel 53, and thereby, the second pointer 41 moves.

Further, an upper gear 53*b* of the remaining battery display wheel 53 integrally rotates with the lower gear 53*a*. The remaining battery display wheel 53 rotates a lower gear 54*a* of the intermediate wheel 54 via the upper gear 53*b*. The lower gear 54*a* of the intermediate wheel 54 integrally rotates with an upper gear 54*b* provided on the front side (dial face 4*a* side) of a ground plane 50. The intermediate wheel 54 rotates a gear 56*a* of the mode display wheel 56 via the upper gear 54*b*. The mode display wheel 56 has a tubular portion 56*b* hollow inside. The tubular portion 56*b* is fitted on the outer circumference side of the rotation shaft 55. The tubular portion 56*b* rotates about the coaxial shaft 40 like the rotation shaft 55. By the rotation of the tubular portion 56*b*, the first pointer 42 is moved.

The first display area 44 is divided into the plurality of display units by the rotation angle dθ on the coaxial shaft 40 (see FIG. 3). The angle dθ is set so that the expression 1 may be satisfied when the reduction ratio of the reduction mechanism B is 1/N.

$$d\theta > \theta 1/N \qquad \text{expression 1}$$

In the embodiment, the angle dθ is set to 30°.

Specifically, regarding the second pointer 41, the reduction ratios of the respective gears in the power transmission mechanism A are set so that the second pointer 41 may make a circuit (360° rotation) when the step motor 51 makes 40 steps. Accordingly, the second pointer 41 moves by the angle obtained by division of 360° by 40.

On the other hand, regarding the first pointer 42, the reduction ratio of the reduction mechanism B is set so that the first pointer 42 may turn by 30° as the single display unit while the second pointer 41 makes a circuit.

When the button 14 is pressed down once, the second pointer 41 makes a circuit (360°) and the first pointer 42 moves by a single marking (single display unit) (30°), and the display mode is switched.

The reduction ratio 1/N of the reduction mechanism B, the angle Γ1 of the maximum range in which the second pointer 41 swings, and the angle dθ of the single display unit in the first display area 44 are defined as shown in the expression 1 for the following reason.

The maximum range in which the second pointer 41 swings is the angle θ1. The reduction ratio of the reduction mechanism B is 1/N, and, when the second pointer 41 turns by a predetermined angle, the first pointer 42 turns by a 1/N of the predetermined angle. Therefore, even when the second pointer 41 turns by the angle θ1, the first pointer 42 turns by the angle θ1/N only. Here, dθ>θ1/N, and, if the second pointer 41 turns by the angle θ1, the swing angle of the first pointer 42 is less than the angle dθ of the display unit in the first display area 44. Therefore, in the case where the information pointed by the second pointer 41 is changed, the probability of misreading of the information (display mode) pointed by the first pointer 42 may be reduced.

Note that the angle dθ may be set so that the relation of expression 2 may be satisfied in place of the expression 1.

$$d\theta/2 > \theta 1/N \qquad \text{expression 2}$$

In this case, when the second pointer 41 turns by the angle θ1, the first pointer 42 turns by the angle θ1/N, and the angle θ1/N is less than a half of the angle dθ of the display unit in the first display area 44. Therefore, the influence by the turning of the second pointer 41 on the first pointer 42 may be further reduced.

According to the electronic watch W according to the above described embodiment, in the information display part 4, the "ALT" area 44*b*, the "COM" area 44*c*, and the "BAR" area 44*d* are arranged in the order of the "ALT" area 44*b*, the "COM" area 44*c*, and the "BAR" area 44*d*.

In the turning direction (revolving direction) of the first pointer 42, the distance between the "ALT" area 44*b* and the "COM" area 44*c* is shorter than the distance between the "ALT" area 44*b* and the "BAR" area 44*d*, and the distance between the "COM" area 44*c* and the "BAR" area 44*d* is shorter than the distance between the "ALT" area 44*b* and the "BAR" area 44*d*.

The user changes the pointed area of the first pointer 42 according to the usage scene, and thereby, switches among the altitude display mode, the compass display mode, and the barometric pressure display mode. For example, in the usage scene of an outdoor sport such as mountain climbing, there is a higher possibility of using the altitude display mode and the compass display mode. Or, in the usage scene of a water sport such as navigation of a sailing boat, there is a higher possibility of using the barometric pressure display mode and the compass display mode.

In the embodiment, the distance between the areas having higher possibilities of being used in the same usage scene (e.g. the distance between the "ALT" area 44*b* and the "COM" area 44*c* having higher possibilities of being used together in the usage scene of mountain climbing or the distance between the "COM" area 44*c* and the "BAR" area 44*d* having higher possibilities of being used together in the usage scene of navigation of a sailing boat) is shorter than the distance between the areas having lower possibilities of being used in the same usage scene (the distance between the "ALT" area 44*b* and the "BAR" area 44*d*). Therefore, the excessive time taken to switch the pointed position of the first pointer 42 in the same usage scene can be suppressed.

Further, for grasping the condition of the electronic watch W, the user may check the operating status and the remaining battery of the electronic watch W by visually recognizing the pointed position of the second pointer 41 and check the current display mode by visually recognizing the pointed position of the first pointer 42.

In the embodiment, the first display area 44 pointed by the first pointer 42 and the second display area 43 pointed by the second pointer 41 are adjacent to each other.

Accordingly, for grasping the condition of the electronic watch W, the user can visually recognize the display mode displayed by the first pointer 42 and the operating status and the remaining battery displayed by the second pointer 41 at a time and lessens the need for large movement of the gaze. Therefore, higher visibility can be obtained with respect to the displayed content of the first pointer 42 and displayed content of the second pointer 41.

In the embodiment, the first pointer 42 and the second pointer 41 coaxially turn.

Accordingly, compared to the case where the first pointer 42 and the second pointer 41 respectively turn about different shafts, the space can be saved.

In the embodiment, the operating status displayed by the second pointer 41 includes the measuring status referring to executing the measurement corresponding to the display mode displayed by the first pointer 42. Further, the area of the characters 43*b* of "MEAS" corresponding to the measuring status is adjacent to the first display area 44 pointed by the first pointer 42.

Accordingly, the user can visually recognize the display mode pointed by the first pointer 42 and the display of executing the measurement corresponding to the display mode at a time.

In the embodiment, the icon 43*a* showing no wireless connection is placed next to "F" (full) of the remaining battery meter 43*c*.

The reception of radio waves including time information (wireless communication) uses higher power. Accordingly, the remaining battery close to the full charge ("F") is a condition for wireless communication. Thus, during the wireless communication, it may be estimated that the probability that the second pointer 41 points "F" of the remaining battery meter 43*c* is higher. Therefore, to quickly switch from the status of wireless communication to no wireless connection, it is desirable to place the icon 43*a* showing no wireless connection next to "F" of the remaining battery.

In the embodiment, the first pointer 42 and the second pointer 41 are coaxially driven by the drive power from the single step motor 51. Accordingly, the number of step motors may be reduced, the number of parts including gears for transmitting the drive power from the drive source may be reduced, the drive source and the parts of gears etc. can be provided in the reduced space, and thereby, the whole watch may be downsized and the degree of freedom of design may be improved.

Figure 7:
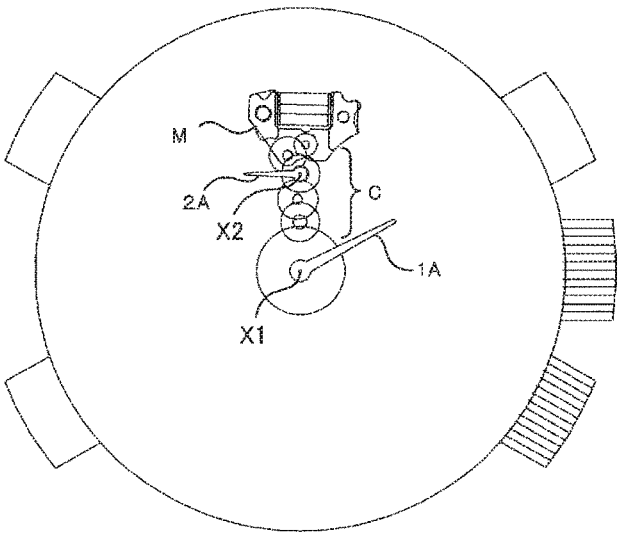
FIG. 7 is a plan view showing the drive system of related art.

Specifically, as in related art, in a multifunctional watch that displays using two pointers by a single step motor, e.g. a configuration shown in FIG. 7 is used.

In the example shown in FIG. 7, drive power of a step motor M is transmitted to a first information pointer LA and a second information pointer 2A using a power transmission mechanism C. However, a rotation shaft X1 of the first information pointer LA and a rotation shaft X2 of the second information pointer 2A are different. That is, in the watch of related art, an area for the power transmission mechanism that transmits the drive power of the step motor M to the separate rotation shafts is necessary and the number of parts is larger. On the other hand, in the electronic watch W according to the embodiment, as shown in FIGS. 5 and 6, the display is performed by the coaxially driven two pointers, and thereby, space-saving placement for the whole watch can be realized.

Particularly, in the embodiment, the first display area 44 is divided into the plurality of display units by the rotation angle dθ on the coaxial shaft 40 and the reduction ratio of the reduction mechanism B is set to 1/N so that the relation of $d\theta > \theta 1/N$ may be satisfied. Accordingly, even when the second pointer 41 is moved by a single marking within the range of the angle θ1, the movement of the first pointer 42 may be kept to a slight amount. As described above, a certain range is provided to the display unit of the first display area 44, and thereby, for switching of the display information of the second pointer 41, misreading of the display information of the first pointer 42 may be prevented.

In the embodiment, the second display area 43 is the range having the center angle θ1 (108°) and the first display area 44 is the range having the center angle θ2 (129°) not overlapping with the second display area 43, and the second display area 43 and the first display area 44 are placed with the coaxial shaft 40 in between. Accordingly, the second display area 43 and the first display area 44 are placed oppositely not to overlap each other, and thereby, the first information and the second information may be easily distinguished and the ease of reading of the first information and the second information may be improved.

In the embodiment, the information display part 5*b* for displaying the day wheel 6 of the calendar is fixedly provided as the third display area for displaying the third information on the line passing through the coaxial shaft 40 and connecting the twelve o'clock side and the six o'clock side in the area not overlapping with the second display area 43 and the first display area 44. Accordingly, the design symmetry may be emphasized and the design stability may be improved.

Modified Examples

The invention is not limited to the above described embodiment, but various modifications may be made.

In the above described embodiment, as shown in FIGS. 2 and 3, the remaining battery meter 43*c* has three stages of "E" (empty), "M" (middle), and "F" (full), however, the number of stages of the display of the remaining battery meter 43*c* can be changed as appropriate.

Figure 8:
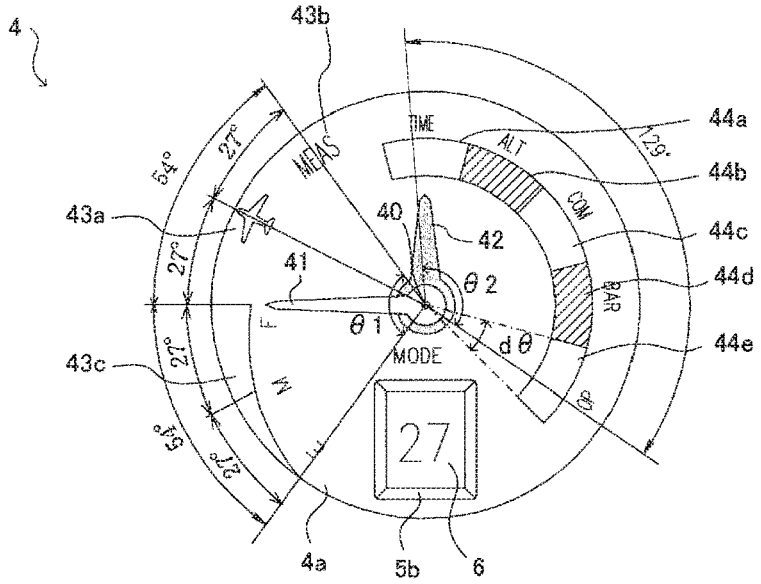
FIG. 8 is a plan view showing an example of the information display part on the six o'clock side.
Figure 9:
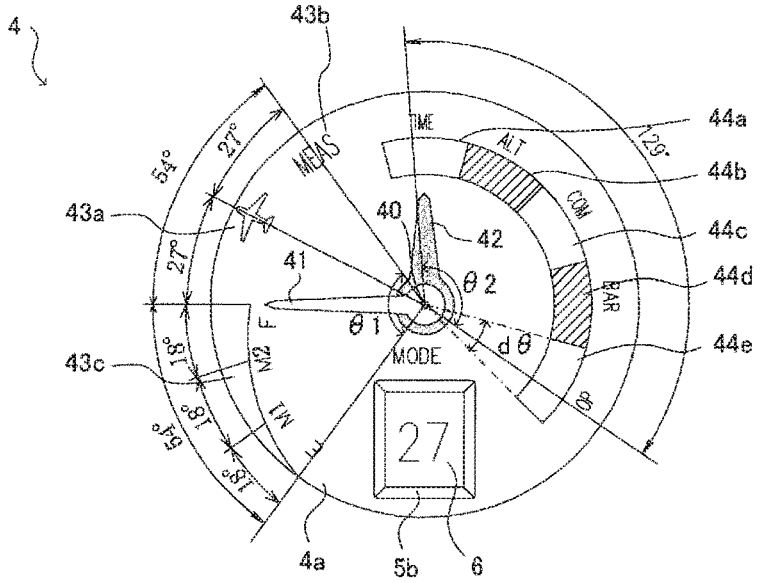
FIG. 9 is a plan view showing a modified example of the information display part on the six o'clock side.

FIG. 8 shows an example of division angles of the remaining battery meter 43*c* when the display of the remaining battery meter 43*c* is divided into three stages as shown in FIGS. 2 and 3. FIG. 9 shows shows an example of division angles of the remaining battery meter 43*c* when the display of the remaining battery meter 43*c* is divided into four stages ("E", "M1" (middle 1), "M2" (middle 2), and "F"). Here, regarding the remaining battery, suppose that a relationship "M1"<"M2" holds. Note that, in either case of the example shown in FIG. 8 and the example shown in FIG. 9, the remaining battery meter 43*c* is the area having the center angle 54° in the dial face 4*a*.

As shown in FIG. 8, when the display of the remaining battery meter 43*c* is divided into three stages, the remaining battery meter 43*c* is divided into "E", "M", and "F" at the center angles 27° in the dial face 4*a*. On the other hand, as shown in FIG. 9, when the display of the remaining battery meter 43*c* is divided into four stages, the remaining battery meter 43*c* is divided into "E", "M1", "M2", and "F" at the center angles 18° in the dial face 4*a*.

In this regard, it is desirable to move the second pointer 41 by an angle obtained by division of 360° by 4*n* (n is a natural number less than 15). As below, this will be explained.

For example, in the case of a configuration of moving the second pointer 41 by an angle obtained by division of 360° by 4n, it is harder to use the drive mechanisms and the parts of moving the pointers by the angle obtained by division of 360° by 60, which are used in many watches, in common, however, the distance at which the second pointer 41 moves by single movement may be made longer and the number of movements with the switching of display (i.e., switching time) can be reduced to a ⅔.

Further, in the case of a configuration of moving the second pointer 41 by an angle obtained by division of 360° by 4n, not limited to the modified example, the top, bottom, left, and right in the six o'clock information display part 4 (here, the top, bottom, left, and right correspond to the twelve o'clock side, six o'clock side, nine o'clock side, and three o'clock side, respectively) can be symmetrically displayed by the second pointer 41. Furthermore, even in the case of the configuration of the remaining battery meter 43*c* as shown in FIGS. 8 and 9, for example, the second pointer 41 is adapted to move by an angle obtained by division of 360° by 4n, and thereby, either display (three-split remaining battery meter or four-split remaining battery meter) can be realized.

Figure 10:
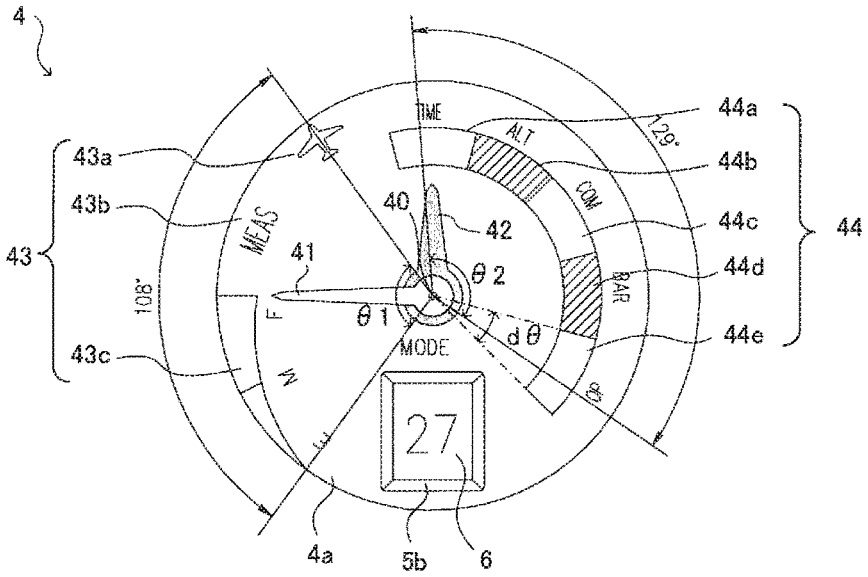
FIG. 10 is a plan view showing another modified example of the information display part on the six o'clock side.

In the six o'clock information display part 4 shown in FIGS. 2 and 3, the area in which the icon 43*a* is placed and the area in which the characters 43*b* of "MEAS" are placed may be exchanged as shown in FIG. 10. Further, as shown in FIG. 11, the remaining battery meter 43*c* may be placed between the area in which the icon 43*a* is placed and the area in which the characters 43*b* of "MEAS".

Figure 11:
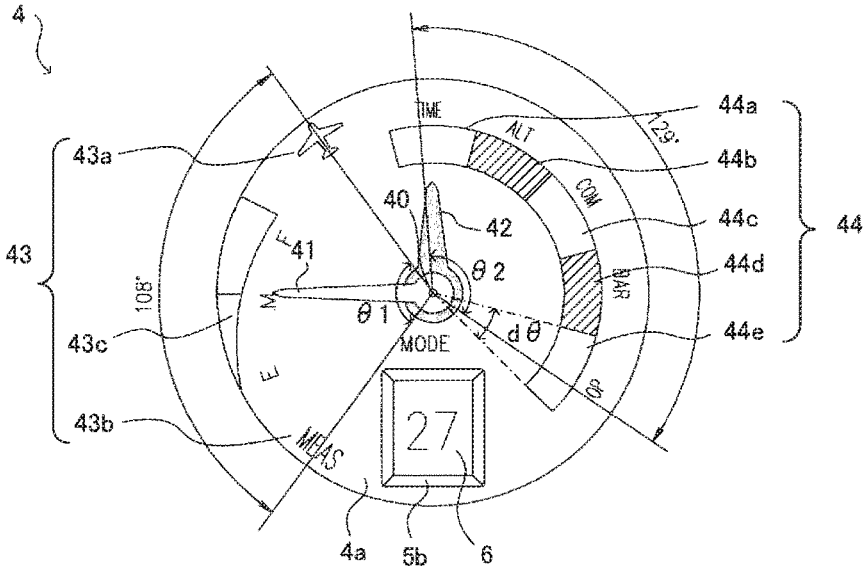
FIG. 11 is a plan view showing yet another modified example of the information display part on the six o'clock side.

In the case of the examples shown in FIGS. 10 and 11, the area next to the remaining battery meter 43*c* is the area of the characters 43*b* of "MEAS".

It is considered that the measurements of the barometric pressure, the attitude, the direction, etc. are frequently used depending on the conditions of the usage scenes of mountain climbing and navigation of a sailing boat (e.g. a usage scene in an unseasonable weather). Accordingly, when the area next to the remaining battery meter 43*c* is the area of the characters 43*b* of "MEAS", the number of drive steps of the step motor 51 necessary for switching the pointed position of the second pointer 41 from the area of the remaining battery meter 43*c* to the area of the characters 43*b* of "MEAS" may be made smaller. Therefore, power consumption can be reduced.

In addition, in the above described embodiment and modified examples, the primary cell is explained as an example of the power source of the drive source for the step motor 51 etc., however, the invention is not limited to that. The power source may take any form. For example, a secondary cell may be used. In this case, the secondary cell may be charged using an external commercial power source of 100 V. Or, a solar cell panel may be provided in the electronic watch W and the secondary cell may be charged using the electric power generated by the solar cell panel.

The entire disclosure of Japanese Patent Application No. 2016-012484, filed Jan. 26, 2016 is expressly incorporated by reference herein.

What is claimed is:

1. An electronic watch comprising:

a dial having at least one hand;

a dial ring disposed on an outer circumference of the dial and including a plurality of markings dividing the dial ring into 100 segments;

an information display part disposed on the dial and having a first area, a second area, a third area, a fourth area, a fifth area, and a sixth area, the first area, second area, and third area indicating an altitude display mode, a compass display mode, and a barometric pressure display mode, the altitude display mode displaying an altitude, the compass display mode displaying a direction, and the barometric pressure display mode displaying a barometric pressure, the sixth area being disposed within the fourth area and adjacent to the area containing the first area, the second area, and the third area, and an area containing the first area, the second area, and the third area being adjacent to an area containing the fourth area and the fifth area;

a first pointer separate from the at least one hand that indicates the altitude display mode by pointing to the first area, indicates the compass display mode by pointing to the second area, and indicates the barometric pressure display mode by pointing to the third area in the information display part; and a second pointer separate from the at least one hand indicates an operating status of the electronic watch by pointing to the fourth area, indicates a remaining battery of the electronic watch by pointing to the fifth area, and indicates that a control unit is executing a measurement corresponding to the display mode displayed by the first pointer by pointing to the sixth area in the information display part, wherein the first area, the second area, and the third area of the information display part are arranged in an order of the first area, the second area, and the third area in a turning direction of the first pointer, and the at least one hand indicates a measurement result obtained in a mode indicated by the first pointer by pointing to at least one of the plurality of markings on the dial ring.

2. The electronic watch according to claim 1, further comprising:

a drive unit that turns the first pointer; and a control unit that controls the drive unit so that the first pointer points to the first area when a display mode is the altitude display mode, the first pointer points to the second area when the display mode is the compass display mode, and the first pointer points to the third area when the display mode is the barometric pressure display mode.

3. The electronic watch according to claim 1, wherein the first pointer and the second pointer coaxially turn.

4. The electronic watch according to claim 1, wherein the second pointer moves by an angle obtained by division of 360° by 4n where n is a natural number less than 15.

5. The electronic watch according to claim 1, wherein the information display part is a subdial positioned on the dial, the information display part being divided into quadrants in an order of first through fourth quadrants starting at a twelve o'clock position and moving clockwise around the subdial, and the first area, the second area, and the third area are positioned in the first and second quadrants on the subdial.

6. The electronic watch according to claim 1, further comprising a seventh area and an eighth area for indicating a time display mode and an optional display mode, wherein the information display part is a subdial positioned on the dial, the information display part being divided into quadrants in an order of first through fourth quadrants starting at the twelve o'clock position and moving clockwise around the subdial, wherein the first area, the second area, the third area, the seventh area, and the eighth area are arranged in an order of the seventh area, the first area, the second area, the third area, and the eighth area clockwise as the first pointer turns, the first, the second, the third, the seventh, and the eighth areas are arranged in the first and second quadrants, and the optional display mode displays biological information of a wearer.

* * * * *